US009966651B2

(12) United States Patent
Lin et al.

(10) Patent No.: US 9,966,651 B2
(45) Date of Patent: May 8, 2018

(54) ANTENNA AND WIRELESS COMMUNICATION DEVICE USING THE SAME

(71) Applicant: Chi Mei Communication Systems, Inc., New Taipei (TW)

(72) Inventors: Te-Chang Lin, New Taipei (TW); Cho-Kang Hsu, New Taipei (TW)

(73) Assignee: Chi Mei Communication Systems, Inc., New Taipei (TW)

( * ) Notice: Subject to any disclaimer, the term of this patent is extended or adjusted under 35 U.S.C. 154(b) by 427 days.

(21) Appl. No.: 13/911,321

(22) Filed: Jun. 6, 2013

(65) Prior Publication Data

US 2013/0335278 A1 Dec. 19, 2013

(30) Foreign Application Priority Data

Jun. 15, 2012 (TW) ..... 101121516 A

(51) Int. Cl.

| | |
|---|---|
| ***H01Q 1/22*** | (2006.01) |
| ***H01Q 1/12*** | (2006.01) |
| ***H01Q 1/24*** | (2006.01) |
| ***H01Q 9/42*** | (2006.01) |

(52) U.S. Cl.

CPC ..... *H01Q 1/22* (2013.01); *H01Q 1/12* (2013.01); *H01Q 1/243* (2013.01); *H01Q 9/42* (2013.01)

(58) Field of Classification Search

CPC ..... H01Q 1/22; H01Q 1/243; H01Q 1/12; H01Q 9/42; H01C 1/243

USPC ..... 343/702, 878

See application file for complete search history.

(56) References Cited

U.S. PATENT DOCUMENTS

| | | | | |
|---|---|---|---|---|
| 5,757,326 A * | 5/1998 | Koyama | H01Q 1/22 343/702 |
| 8,665,164 B2 * | 3/2014 | Hill | H01Q 1/243 343/702 |
| 2010/0123632 A1 * | 5/2010 | Hill | H01Q 1/243 343/702 |
| 2013/0335277 A1 * | 12/2013 | Chang et al. | 343/702 |

FOREIGN PATENT DOCUMENTS

| | | |
|---|---|---|
| CN | 101420060 A | 4/2009 |
| CN | 101483270 A | 7/2009 |
| CN | 101814649 A | 8/2010 |
| CN | 102142855 A | 8/2011 |
| TW | 201222974 A | 6/2012 |

* cited by examiner

*Primary Examiner* — Graham Smith
*Assistant Examiner* — Noel Maldonado
(74) *Attorney, Agent, or Firm* — ScienBiziP, P.C.

(57) ABSTRACT

A wireless communication device includes a housing and an antenna. The housing includes a frame. The frame includes a metal portion and a non-metal portion connected to the metal portion. The antenna includes a base board and a radiating body. The radiating body is partially surrounding the base and electrically connected to the base board. The radiating body is formed by the metal portion.

5 Claims, 5 Drawing Sheets

ANTENNA AND WIRELESS COMMUNICATION DEVICE USING THE SAME

BACKGROUND

1. Technical Field

The disclosure generally relates to antennas, and particularly to an antenna used in global position system (GPS) and a wireless communication device using the antenna.

2. Description of Related Art

Wireless communication devices usually include an antenna used to transmit and receive wireless communication signals. In addition, to appear aesthetically pleasing to consumers, the shells of the wireless communication devices are made of metal. However, the metal shells may generate interference to the antenna and lead to a frequency shift of the antenna. Therefore, the communication performance of the antenna may be negatively affected.

Furthermore, the antenna positioned in the wireless communication device commonly occupies a relatively lager space of the wireless communication device, making it difficult to miniaturize the wireless communication devices.

Therefore, there is room for improvement within the art.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the disclosure.

DETAILED DESCRIPTION

Figure 1:
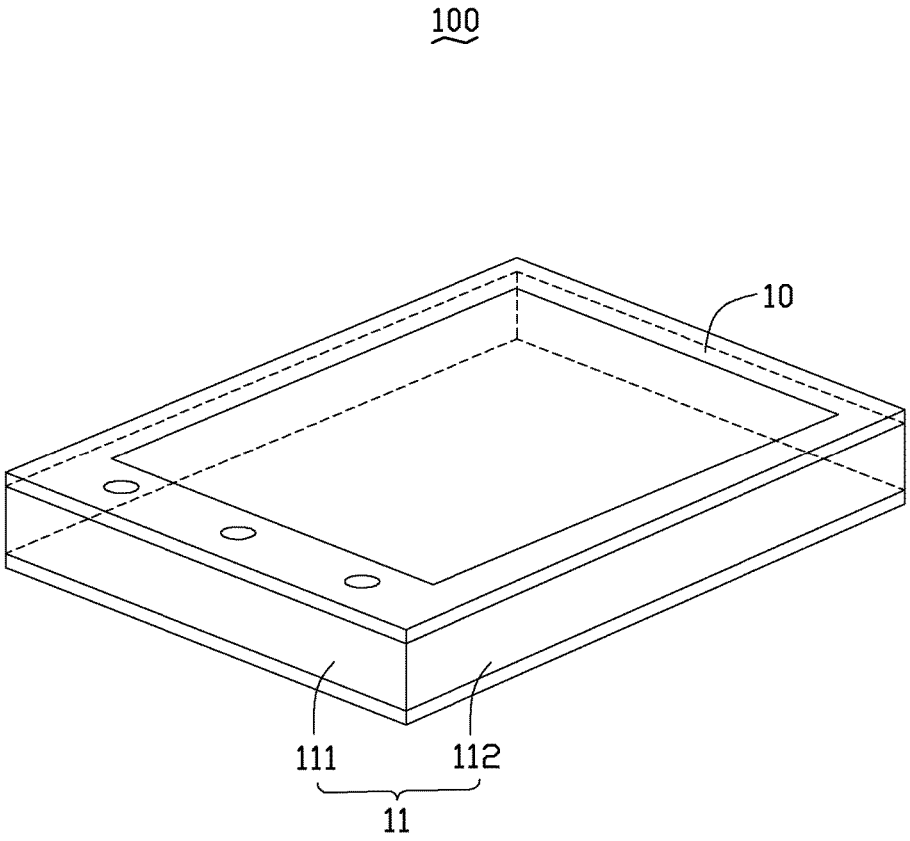
FIG. 1 is a schematic view of a wireless communication device, according to an exemplary embodiment of the disclosure.

FIG. 1 is a schematic view of a wireless communication device 100, according to an exemplary embodiment of the disclosure. The wireless communication device 100 can be a mobile phone, a personal digital assistant (PDA), and so on. In the exemplary embodiment, the wireless communication device 100 is a mobile phone. The wireless communication device 100 includes a housing 10 and an antenna 30 (shown in FIG. 2).

The housing 10 is a shell of the wireless communication device 100 including a substantial U-shaped frame 11. The frame 11 includes a metal portion 111 and a non-metal portion 112 connected to the metal portion 111. The non-metal portion 112 may be made of plastic.

Figure 2:
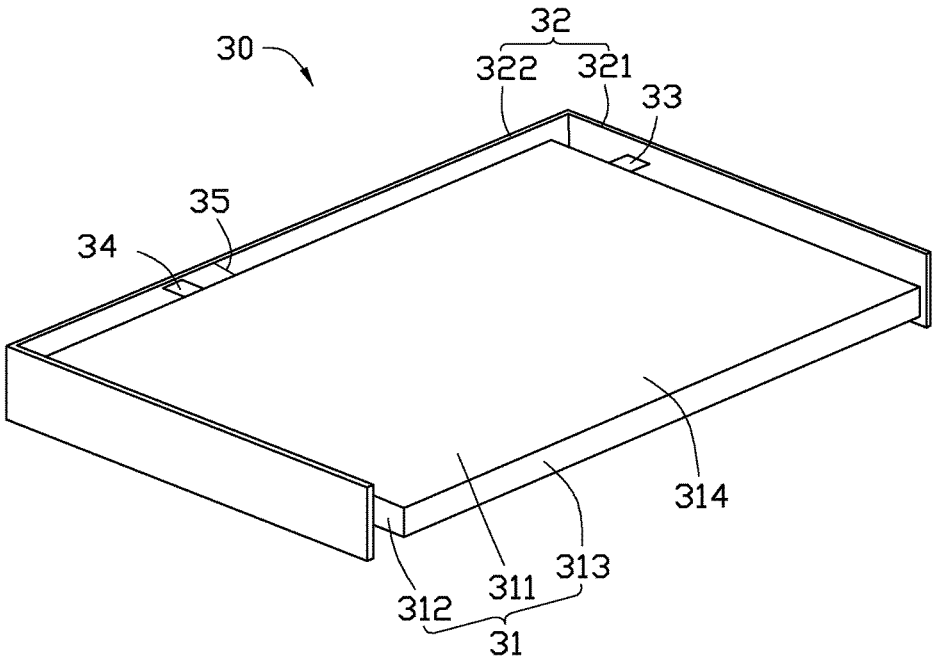
FIG. 2 is a schematic view of an antenna, according to an exemplary embodiment of the disclosure.
Figure 3:
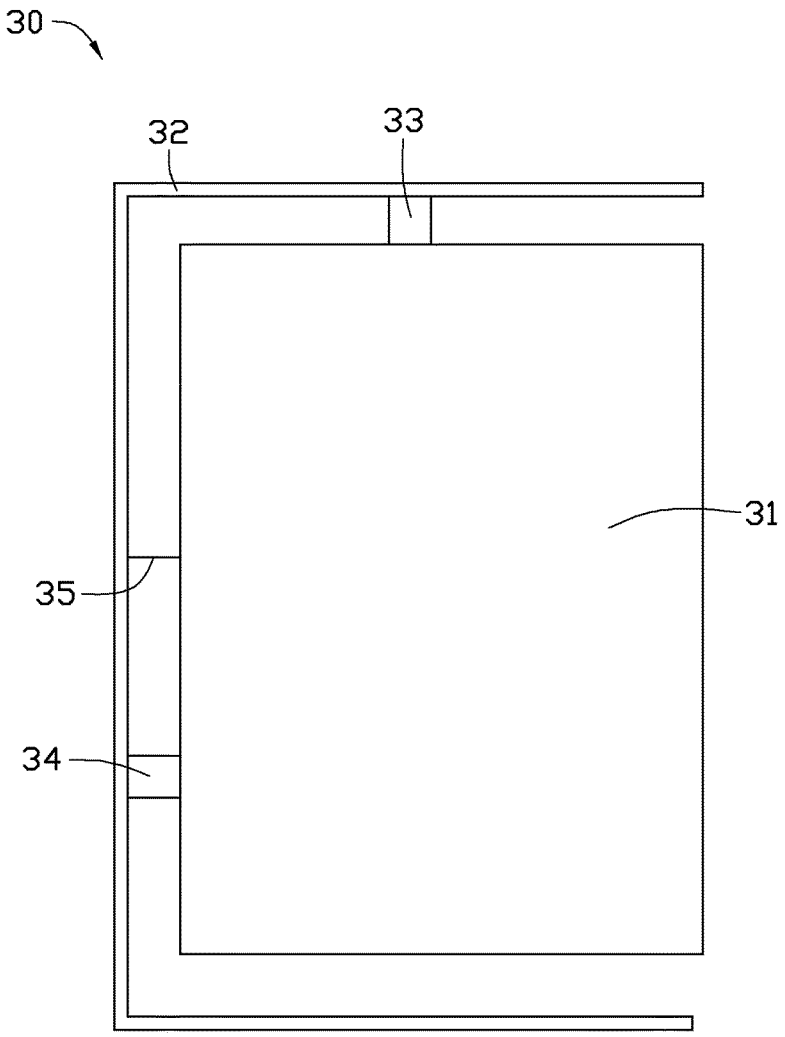
FIG. 3 is a planar view of the antenna of FIG. 2.

Referring to FIG. 2, the antenna 30 includes a base board 31, a radiating body 32, a first ground end 33, a second ground 34, and a feed member 35.

The base board 31 is a substantially rectangular plate including a top surface 311. Two opposite first edge surfaces 312 and two opposite second edge surfaces 313 perpendicularly extending from the four edges of the top surface 311. In one exemplary embodiment, the base board 31 is a main circuit board of the wireless communication device 100. The top surface 311 includes a ground area 314 configured to provide ground for the antenna 30.

The radiating body 32 is formed by a metal sheet. The radiating body 32 is substantially a U-shaped frame and includes two parallel first radiating sections 321 and a second radiating section 322 connecting to the first radiating sections 321. The radiating body 32 partially surrounds the base board 31 with the first radiating sections 321 parallel to and spaced from the first edge surfaces 313 and the second radiating section 322 parallel to and spaced from one of the second edge surfaces 313. In the embodiment, the radiating body 32 is formed by the metal portion 111 of the frame 11. The radiating body 32 can be directly formed by exposing the metal portion 111 from the housing 10 or formed by embedding the metal portion in housing 10 using injection molding. Additionally, an insulated layer can be formed on the radiating body 32 to prevent a frequency shift of the antenna 30 resulting from user contact of the radiating body 32.

The first ground end 33 and the second ground end 34 are substantially rectangular sheets having substantially the same dimensions. The first ground end 33 is positioned between one of the first radiating sections 321 and one of the corresponding first edge surfaces 312 and interconnects the one of the first radiating sections 321 and one of the corresponding first edge surfaces 312. The second ground end 34 is positioned between the second radiating section 322 and one of the corresponding second edge surfaces 313 and interconnects the second radiating section 322 and the corresponding second edge surface 313.

The feed member 35 may be a wire interconnecting the second radiating section 322 and one of the corresponding second edge surface 313.

In use, to send signals from the wireless communication device 100 to other devices, the signals are transmitted to the radiating body 32 from the base board 31 by the feed member 35. To receive the signals from the other devices, the radiating body 32 receives the signals from the other devices and sends the signals to the base board 31 by the feed member 35.

Figure 4:
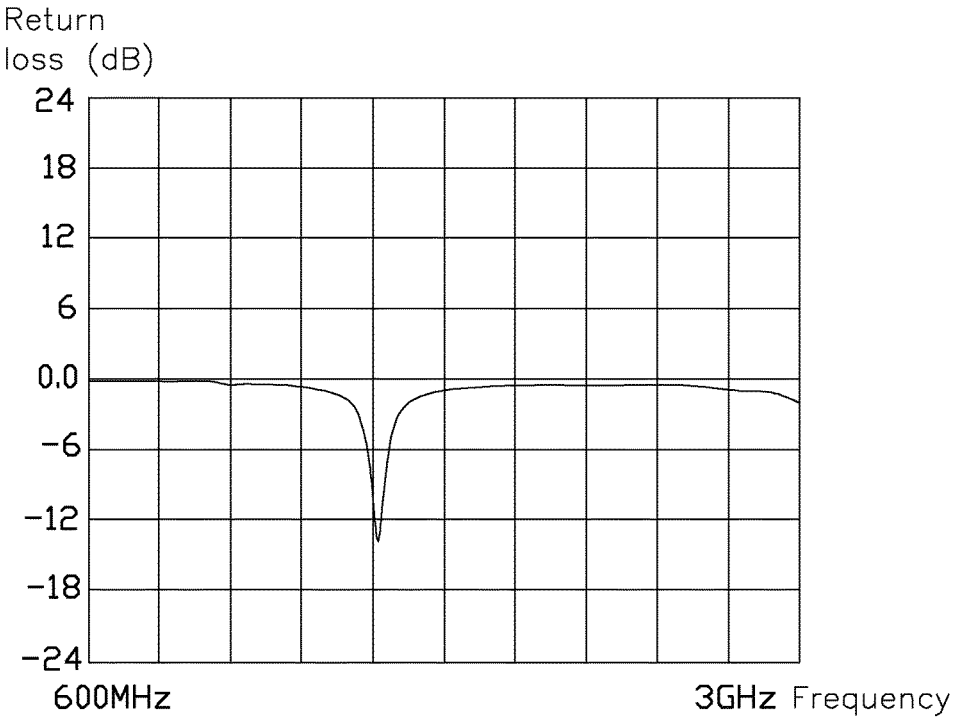
FIG. 4 is a diagram showing RL (return loss) measurement of the antenna shown in FIG. 2.
Figure 5:
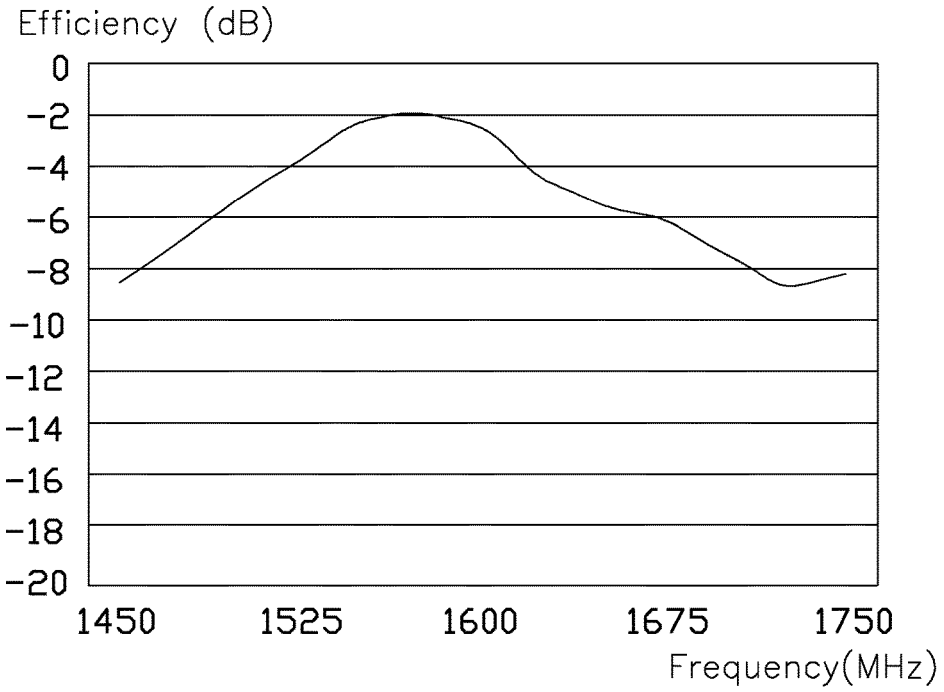
FIG. 5 is a diagram showing efficiency measurement of the antenna shown in FIG. 2.

Referring to FIGS. 4 and 5, in the embodiment, the antenna 30 can be used in a global position system. In addition, the resonance frequency of the antenna 30 can be adjusted by changing the position of the first ground end 33 relative to the base board 31.

The radiating body 32 of the wireless communication device 30 is formed by the metal portion 111 of the frame 11 and integrated with the housing 10 so that the radiating body 32 occupies a relatively smaller space of the wireless communication device 100 and benefits miniaturization of the wireless communication device 100. In addition, because the radiating body 32 is exposed from the housing 10, it is not susceptible to interference of other elements of the wireless communication device 100 and can obtain a relatively stable performance.

It is believed that the exemplary embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. A wireless communication device, comprising:

a housing comprising a frame, the frame comprising a metal portion and a non-metal portion connected to the metal portion; and an antenna, the antenna comprising:

a base board, the base board comprising:

a top surface comprising a plurality of edges, and two opposite first edge surfaces perpendicularly extending from the plurality of edges of the top surface;

two opposite second edge surfaces perpendicularly extending from the plurality of edges of the top surface; and a radiating body partially surrounding the base board and electrically connected to the base board; wherein the radiating body is formed by the metal portion and exposed from the housing, the radiating body is formed by embedding the metal portion in the housing using injection molding and an insulated layer is formed on the radiating body to prevent a frequency shift of the antenna resulting from user contact of the radiating body, the radiating body comprising:

two parallel first radiating sections, each of the two first radiating sections parallel to and spaced from the two first edge surfaces; and a second radiating section connecting to the two first radiating sections, the second radiating section parallel to and spaced from one of the second edge surfaces;

a first ground end positioned between one of the first radiating sections and one of the corresponding first edge surfaces and interconnecting the one of the two first radiating sections and the one of the two corresponding first edge surfaces; and a second ground end positioned between the second radiating section and one of the corresponding second edge surfaces and interconnecting the second radiating section and the one of the corresponding second edge surface;

wherein the first ground end and the second ground end are rectangular sheets having substantially the same dimensions.

2. The wireless communication device of claim 1, wherein the base board is a main circuit board of the wireless communication device.

3. A wireless communication device, comprising:

a housing;

an antenna, the antenna comprising:

a base board, the base board comprising:

a top surface comprising a plurality of edges, and two opposite first edge surfaces perpendicularly extending from the plurality of edges of the top surface;

two opposite second edge surfaces perpendicularly extending from the plurality of edges of the top surface; and a radiating body partially surrounding the base board and electrically connected to the base board; wherein the radiating body is integrated with the housing and exposed from the housing, the radiating body is embedded in the housing using injection molding and an insulated layer is formed on the radiating body to prevent a frequency shift of the antenna resulting from user contact of the radiating body, the radiating body comprising:

two parallel first radiating sections, each of the two first radiating sections parallel to and spaced from the two first edge surfaces; and a second radiating section connecting to the two first radiating sections, the second radiating section parallel to and spaced from one of the second edge surfaces;

a first ground end positioned between one of the first radiating sections and one of the corresponding first edge surfaces and interconnecting the one of the two first radiating sections and the one of the two corresponding first edge surfaces; and a second ground end positioned between the second radiating section and one of the corresponding second edge surfaces and interconnecting the second radiating section and the one of the corresponding second edge surface;

wherein the first ground end and the second ground end are rectangular sheets having substantially the same dimensions.

4. The wireless communication device of claim 3, wherein the housing comprises a frame, the radiating body is a metal portion of the frame.

5. The wireless communication device of claim 3, wherein the base board is a main circuit board of the wireless communication device.

* * * * *